US006457596B1

(12) United States Patent
Verseman

(10) Patent No.: US 6,457,596 B1
(45) Date of Patent: Oct. 1, 2002

(54) ERGODYNAMIC BOTTLE TOP

(76) Inventor: Steve Verseman, 122 Forest Knoll Dr., Fishers, IN (US) 46038

( * ) Notice: Subject to any disclaimer, the term of this patent is extended or adjusted under 35 U.S.C. 154(b) by 0 days.

(21) Appl. No.: 09/340,415

(22) Filed: Jun. 28, 1999

(51) Int. Cl.[7] ..... B65D 83/00

(52) U.S. Cl. ..... 215/387; 215/11.4; 215/228; 215/311; 215/389; 220/212.5; 220/715; 222/475; 222/525

(58) Field of Search ..... 215/11.4, 228, 215/309, 311, 387, 389; 220/212.5, 714, 715; 222/475, 521, 524, 525

(56) References Cited

U.S. PATENT DOCUMENTS

| | | | | | |
|---|---|---|---|---|---|
| 1,957,854 | A | * | 5/1934 | Smith | 222/475 X |
| 3,754,691 | A | * | 8/1973 | Flider | 222/525 |
| 5,184,740 | A | * | 2/1993 | Mandrell, II et al. | 215/315 |
| 5,337,931 | A | * | 8/1994 | Kitterman | 222/525 |
| 5,489,050 | A | * | 2/1996 | Finkiewicz et al. | 222/525 |
| 6,029,855 | A | * | 2/2000 | Adams | 222/78 |

* cited by examiner

*Primary Examiner*—Stephen K. Cronin

(57) ABSTRACT

An ergodynamic bottle top (10) has a push button bottle top post (14A) having a push button bottle top doughnut (14B). The push button bottle top doughnut (14B) is slidably positioned therearound. The ergodynamic bottle top (10) further has a handle (12) having a left handle (12L) which is securely attached to a right handle (12R) by a center handle (12C). The center handle (12C) has a center handle opening (12CA) therethrough. The center handle (12C) is securely attached to the push button bottle top doughnut (14B). The center handle opening (12CA) comprises a similar or greater diameter than a diameter of the push button bottle top post (14A). The center handle opening (12CA) could comprise a smaller diameter than a diameter of the push button bottle top post (14A) functioning to increase pressure to an eminating stream. The left handle (12L) comprises at least one left handle side concave (12LA) positioned between the outer distal and the center handle (12C) functioning to facilitate placement and gripping of a user's finger. The left handle (12L) further comprises at least one left handle connector (12LB) positioned between the left handle (12L) and the center handle (12C) functioning as a reinforcement. The left handle (12L) further comprises a left handle bottom concave (12LC) functioning to facilitate placement and gripping of a user's finger. The right handle (12R) comprises at least one right handle side concave (12RA) positioned between the outer distal and the center handle (12C) functioning to facilitate placement and gripping of a user's finger. The right handle (12R) further comprises at least one right handle connector (12RB) positioned between the right handle (12R) and the center handle (12C) functioning as a reinforcement. The right handle (12R) further comprises a right handle bottom concave (12RC) functioning to facilitate placement and gripping of a user's finger.

10 Claims, 4 Drawing Sheets

ERGODYNAMIC BOTTLE TOP

BACKGROUND OF THE INVENTION

1. Field of the Invention

The present invention relates to container caps. More particularly, the present invention relates to sports bottle caps.

2. Description of the Prior Art

There are various containers sold which have a cap with a pull up opening device such as soap, water bottles, fruit drink bottles and energy drink bottles. The prior art bottles are difficult to open and require considerable force to do so. Soap bottles in particular are difficult after the soap has collected on the outside of the container during use causing the container and the opening device to becone very slippery.

Numerous-innovations for ergodynamic bottle tops have been provided in the prior art that are described as follows. Even though these innovations may be suitable for the specific individual purposes to which they address, they differ from the present invention as hereinafter contrasted.

In U.S. Pat. No. 5,535,644, titled Opener for Removing a Container Cap, invented by Raoul Paul-Alexandre and Anthony Cifelli, an opener device can remove a container cap with a discrete, rigid tab mounted in a notch formed in a handle. The notch is formed in a first end of the handle and extends transversely across the handle for engaging the container cap. The tab is mounted at one of a pair of banks bordering the notch. The tab extends partially into the notch for engaging the container cap. The handle can have a centrally located transverse bore adapted to hold a corkscrew coaxially. For a hollow handle, the corkscrew can be stored inside the handle.

The patented invention differs from the present invention because the patented invention is a standalone opener device which is separate from the cap and functions with a general range of container caps. The patented invention includes a corkscrew which stores in a hollow handle. The present invention is a bottle cap which has features making opening the nozzle easier. The patented invention lacks features similar to the present invention.

In U.S. Pat. No. 5,097,729, titled Bottle and Jar Cap Opener, invented by Dwight C. Brown, a device is described for removing caps from bottles, jars, etc. The device includes a pair of handles with a pivot therebetween and a gripping band connected to the handles for tightly gripping the cap to be removed. The handles include gripping portions to tightly grip the cap in combination with the gripping band. The device may be provided with an adjustable length gripping band in combination with a band locking retainer to accommodate various size caps.

The patented invention differs from the present invention because the patented invention is a standalone opener device which is separate from the cap and functions with a general range of screw on container caps. The present invention is a bottle cap which has features making opening the nozzle easier. The patented invention lacks features similar to the present invention.

In U.S. Pat. No. 4,052,917, titled Jar and Bottle Cap Opener, invented by Beryl Gee, a jar and bottle cap opener is described having a pair of interchangeably sized gripping jaws slid into engagement along a handle with opposite surfaces of a jar or bottle cap and locked into firm gripping engagement therewith. The handle is then rotated to twist off the cap.

The patented invention differs from the present invention because the patented invention is a standalone opener device which is separate from the cap and functions with a general range of screw on container caps. The present invention is a cap having an attachment means functioning to easily remove the cap of a bottle. The cap includes a pull up nozzle functioning in a closed position to prevent fluid from flowing from the bottle when inverted. An opening aid is securely attached to the pull up nozzle. The opening aid has a pair of finger grips functioning to provide a gripping point for a user's fingers. The cap further includes a hollow pipe having a lower end and an upper end, securely attached at the lower end to the pull up nozzle and open at the upper end. The hollow pipe functions to direct fluid from the pull up nozzle beyond the finger grips to the user.

Numerous innovations for an ergodynamic bottle top have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a cap having an attachment means functioning to easily remove the cap of a bottle. The cap includes a pull up nozzle functioning in a closed position to prevent fluid from flowing from the bottle when inverted. When the bottle is inverted and the pull up nozzle is in an open position, fluid can freely flow out of the bottle. An opening aid is securely attached to the pull up nozzle. The opening aid has a pair of finger grips functioning to provide a gripping point for a user's fingers. The cap further includes a hollow pipe having a lower end and an upper end, securely attached at the lower end to the pull up nozzle and open at the upper end. The hollow pipe functions to direct fluid from the pull up nozzle beyond the finger grips to the user.

The types of problems encountered in the prior art are opening the cap of a container when the cap is slippery, the users has sore teeth, weak jaw muscles, arthritis, sore hands, or a weak grip.

In the prior art, unsucessful attempts to solve this problem were attempted by namely a mushroomed shaped opening device. However, the problem was solved by the present invention because a plurality of opening aids are provided on the opening device permitting a more secure grip.

Innovations within the prior art are rapidly being exploited as drink containers are manufactured with the pull opening caps and the population ages resulting in more people having difficulty opening the container tops because of the effects of sore teeth, weak jaw muscles, arthritis, sore hands, or a weak grip.

The present invention went contrary to the teaching of the art by providing a handle which is attached to the opening device.

The present invention solved a long felt need for an improvement to the mechanics of opening a sports bottle.

Accordingly, it is an object of the present invention to provide a push button bottle top having a push button bottle top post and a push button bottle top doughnut.

More particularly, it is an object of the present invention to provide a handle which attached to the push button bottle top post.

In keeping with these objects, and with others which will become apparent hereinafter, one feature of the present invention resides, briefly stated, in a left handle having a left handle side concave functioning to provide a grip for a user's hand.

Another feature of the present invention is that a left handle connector joins a left handle side concave to a center handle functioning to provide a strong joint.

Yet another feature of the present invention is that right handle is positioned opposite the left handle providing a symmetrical grip for the user.

Still another feature of the present invention is that a center handle opening extends the opening outwardly functioning to position the opening proximal to the user.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

List of Reference Numerals Utilized in the Drawings

10—ergodynamic bottle top (10)
12—handle (12)
12L—left handle (12L)
12LA—left handle side concave (12LA)
12LB—left handle connector (12LB)
12LC—left handle bottom concave (12LC)
12R—right handle (12R)
12RA—right handle side concave (12RA)
12RB—right handle connector (12RB)
12RC—right handle bottom concave (12RC)
12C—center handle (12C)
12CA—center handle opening (12CA)
14—push button bottle top (14)
14A—push button bottle top post (14A)
14B—push button bottle top doughnut (14B)

DESCRIPTION OF THE PREFERRED EMBODIMENT

Figure 1:
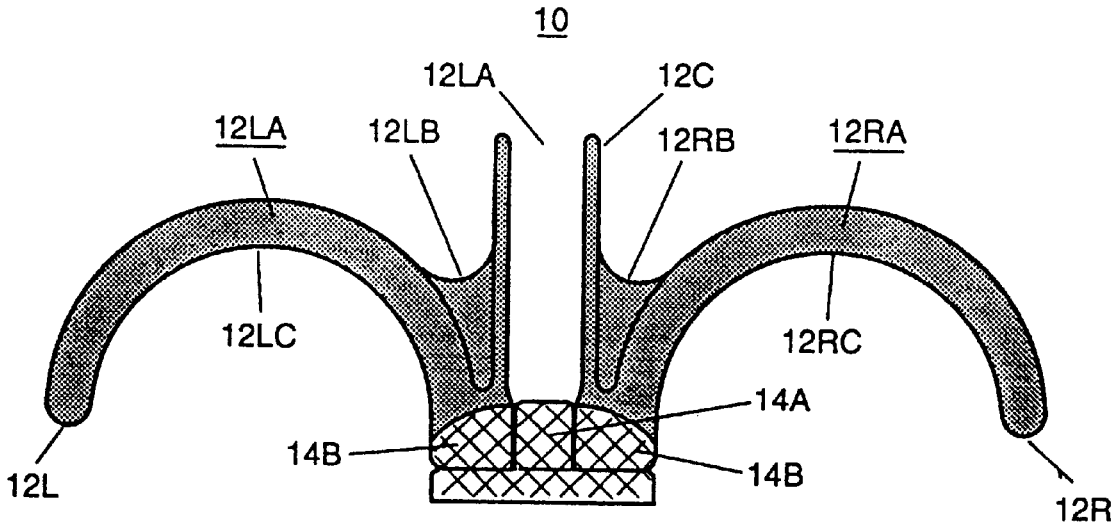
FIG. 1 is a cross sectional view of an ergodynamic bottle top (10) along line 1—1 of FIG. 2.
Figure 2:
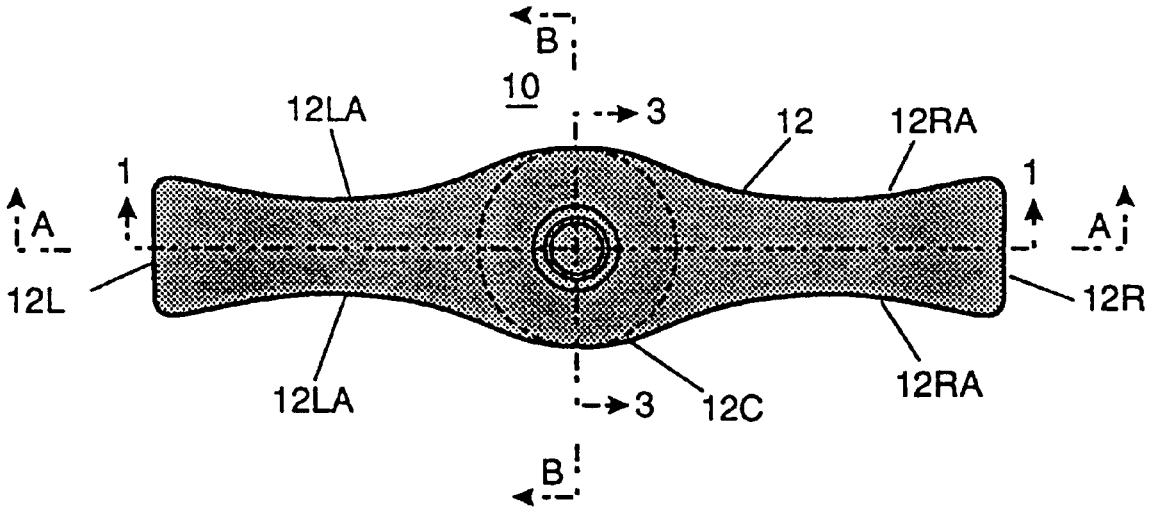
FIG. 2 is a top view of an ergodynamic bottle top (10).
Figure 3:
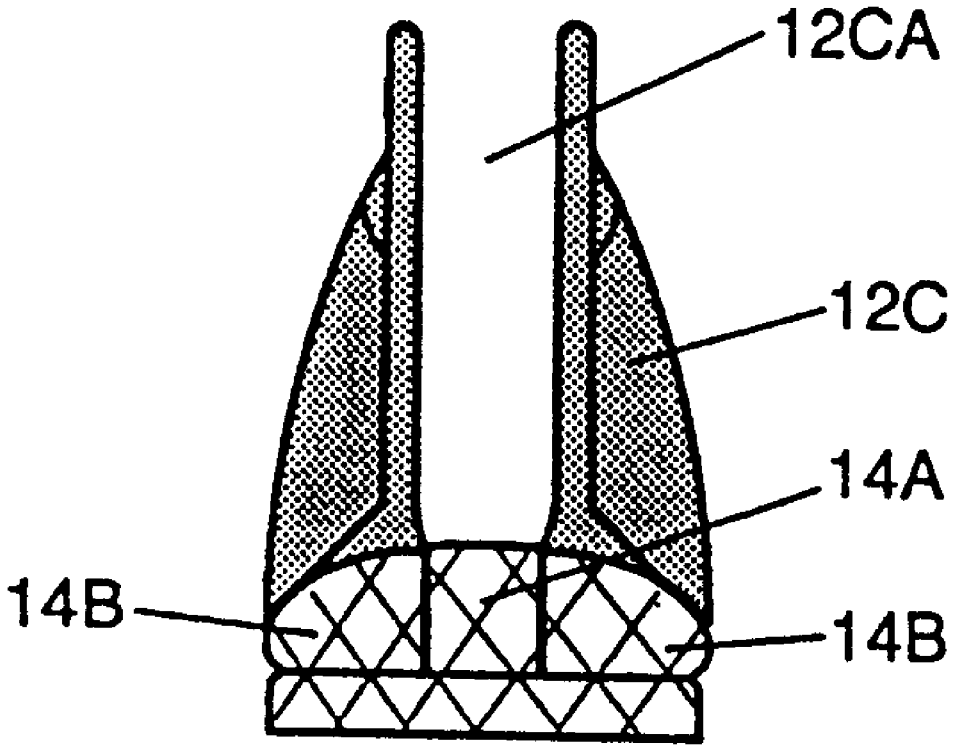
FIG. 3 is a cross sectional view of an ergodynamic bottle top (10) along line 3—3 of FIG. 2.

Referring to FIG. 1 which is a cross sectional view of an ergodynamic bottle top (10) along line 1—1 of FIG. 2, FIG. 2 which is a top view of the ergodynamic bottle top (10), and FIG. 3 which is a cross sectional view of an ergodynamic bottle top (10) along line 3—3 of FIG. 2 together. The ergodynamic bottle top (10) securely affixed to a standard push button bottle top (14). The ergodynamic bottle top (10) comprises a push button bottle top post (14A) having a push button bottle top doughnut (14B). The push button bottle top doughnut (14B) is slidably positioned therearound.

The ergodynamic bottle top (10) further comprises a handle (12) having a left handle (12L) which is securely attached to a right handle (12R) by a center handle (12C). The center handle (12C) has a center handle opening (12CA) therethrough. The center handle (12C) is securely attached to the push button bottle top doughnut (14B). The center handle opening (12CA) comprises a similar or greater diameter than a diameter of the push button bottle top post (14A). The center handle opening (12CA) could comprise a smaller diameter than a diameter of the push button bottle top post (14A) functioning to increase pressure to an eminating stream. The center handle (12C) further functions to position the stream proximal to a user.

The left handle (12L) comprises at least one left handle side concave (12LA) positioned between the outer distal and the center handle (12C) functioning to facilitate placement and gripping of a user's finger. The left handle (12L) further comprises at least one left handle connector (12LB) positioned between the left handle (12L) and the center handle (12C) functioning as a reinforcement. The left handle (12L) further comprises a left handle bottom concave (12LC) functioning to facilitate placement and gripping of a user's finger. The right handle (12R) comprises at least one right handle side concave (12RA) positioned between the outer distal and the center handle (12C) functioning to facilitate placement and gripping of a user's finger. The right handle (12R) further comprises at least one right handle connector (12RB) positioned between the right handle (12R) and the center handle (12C) functioning as a reinforcement. The right handle (12R) further comprises a right handle bottom concave (12RC) functioning to facilitate placement and gripping of a user's finger.

The ergodynamic bottle top (10) is manufacturered from a material selected from a group consisting of metal, metal alloy, plastic, plastic composite, rubber, and rubber composite.

Figure 4:
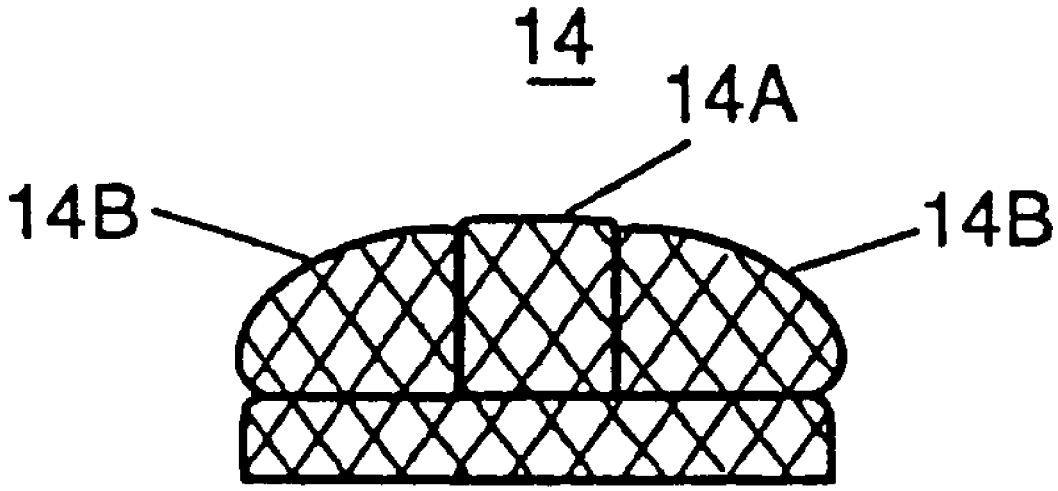
Fig. 4 PRIOR ART
FIG. 4 is cross sectional view of a standard push button bottle top (14) commonly found in the prior art.

FIG. 4 is cross sectional view of a standard push button bottle top (14) commonly found in the prior art.

While the invention has been illustrated and described as embodied in a ergodynamic bottle top, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An ergodynamic bottle top (10) securely affixed to a standard push button bottle top (14) which comprises a push button bottle top post (14A) having a push button bottle top doughnut (14B) slidably positioned therearound, the ergodynamic bottle top (10) comprising:

a handle (12) which comprises a left handle (12L) securely attached to a right handle (12R) by a center handle (12C) having a center handle opening (12CA) therethrough, the center handle (12C) is securely attached to the push button bottle top doughnut (14B), the center handle opening (12CA) comprises a similar or greater diameter than a diameter of the push button bottle top post (14A).

2. The ergodynamic bottle top (10) as described in claim 1, wherein the left handle (12L) comprises at least one left handle side concave (12LA) positioned between the outer distal and the center handle (12C) functioning to facilitate placement and gripping of a user's finger.

3. The ergodynamic bottle top (10) as described in claim 1, wherein the left handle (12L) further comprises at least one left handle connector (12LB) positioned between the left handle (12L) and the center handle (12C) functioning as a reinforcement.

4. The ergodynamic bottle top (10) as described in claim 1, wherein the left handle (12L) further comprises a left handle bottom concave (12LC) functioning to facilitate placement and gripping of a user's finger.

5. The ergodynamic bottle top (10) as described in claim 1, wherein the right handle (12R) comprises at least one right handle side concave (12RA) positioned between the outer distal and the center handle (12C) functioning to facilitate placement and gripping of a user's finger.

6. The ergodynamic bottle top (10) as described in claim 1, wherein the right handle (12R) further comprises at least one right handle connector (12RB) positioned between the right handle (12R) and the center handle (12C) functioning as a reinforcement.

7. The ergodynamic bottle top (10) as described in claim 1, wherein the right handle (12R) further comprises a right handle bottom concave (12RC) functioning to facilitate placement and gripping of a user's finger.

8. The ergodynamic bottle top (10) as described in claim 1 is manufactured from a material selected from a group consisting of metal, metal alloy, plastic, plastic composite, rubber, and rubber composite.

9. The ergodynamic bottle top (10) as described in claim 1, wherein the center handle opening (12CA) comprises a similar or greater diameter than a diameter of the push button bottle top post (14A).

10. The ergodynamic bottle top (10) as described in claim 1, wherein the center handle opening (12CA) could comprise a smaller diameter than a diameter of the push button bottle top post (14A) functioning to increase pressure to an eminating stream.

* * * * *

UNITED STATES PATENT AND TRADEMARK OFFICE
Certificate

Patent No. 6,457,596 B1 Patented: October 1, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Steve Verseman, Fishers, IN; Michele R. Millikan, Carmel, IN; and Amy L. Walker, Carmel, IN.

Signed and Sealed this Twenty-third Day of December 2003.

LEE W. YOUNG
*Supervisory Patent Examiner*
*Art Unit 3727*